US008555673B2

(12) United States Patent
Darde et al.

(10) Patent No.: US 8,555,673 B2
(45) Date of Patent: Oct. 15, 2013

(54) METHOD AND DEVICE FOR SEPARATING A MIXTURE OF AT LEAST HYDROGEN, NITROGEN, AND CARBON MONOXIDE BY CRYOGENIC DISTILLATION

(75) Inventors: Arthur Darde, Paris (FR); Antoine Hernandez, Le Plessis-Trevise (FR)

(73) Assignee: L'Air Liquide, Société pour l'Étude et l'Exploitation des Procédés Georges Claude, Paris (FR)

( * ) Notice: Subject to any disclaimer, the term of this patent is extended or adjusted under 35 U.S.C. 154(b) by 952 days.

(21) Appl. No.: 12/519,990

(22) PCT Filed: Dec. 12, 2007

(86) PCT No.: PCT/FR2007/052486

§ 371 (c)(1),
(2), (4) Date: Jun. 18, 2009

(87) PCT Pub. No.: WO2008/078040

PCT Pub. Date: Jul. 3, 2008

(65) Prior Publication Data

US 2010/0071411 A1 Mar. 25, 2010

(30) Foreign Application Priority Data

Dec. 21, 2006 (FR) ..... 06 55770

(51) Int. Cl.
*F25J 3/00* (2006.01)

(52) U.S. Cl.
USPC ..... 62/625; 62/621; 62/622; 62/623; 62/624

(58) Field of Classification Search
USPC ..... 62/920, 620–631
See application file for complete search history.

(56) References Cited

U.S. PATENT DOCUMENTS 3,756,036 A * 9/1973 Ezell ..... 62/625
3,886,756 A * 6/1975 Allam et al. ..... 62/625
4,478,621 A * 10/1984 Fabian ..... 62/630
4,969,338 A * 11/1990 Kirshnamurthy et al. ..... 62/373
5,992,175 A * 11/1999 Yao et al. ..... 62/621

(Continued)

FOREIGN PATENT DOCUMENTS

DE 19541339 5/1997
FR 2879595 A1 * 6/2006

OTHER PUBLICATIONS

English translation of abstract for FR2879595.*
Berninger, R., "Fortschritte Bei Der H2/CO-Tieftemperaturzerlegung" Berichte Aus Technik Und Wissenschaft, Linde AG. Wiesbaden, DE, vol. 62, 1988, pp. 18-23.

(Continued)

*Primary Examiner* — Frantz Jules
*Assistant Examiner* — Henry Crenshaw

(57) ABSTRACT

The invention relates to a method and apparatus for separating a mixture containing carbon monoxide, nitrogen and hydrogen by cryogenic distillation in a separation system which includes a denitrification column and at least another column. The method can include separating the mixture in order to obtain a fluid enriched with carbon monoxide and containing nitrogen, separating the fluid in the denitrification column, pressurizing the carbon monoxide flow from the column in a compressor up to a high pressure, collecting a fraction of carbon monoxide flow to be used as a product, expanding an amount of the high-pressure carbon monoxide flow in a valve prior to supplying it to the denitrification column, and varying the flow expanded in the valve according to re-boiling needs of the denitrification column.

11 Claims, 1 Drawing Sheet

(56) References Cited

U.S. PATENT DOCUMENTS

| | | | | |
|---|---|---|---|---|
| 6,062,042 | A * | 5/2000 | McNeil et al. | 62/625 |
| 6,073,461 | A * | 6/2000 | McNeil et al. | 62/625 |
| 7,107,788 | B2 * | 9/2006 | Patel et al. | 62/625 |
| 2005/0126220 | A1 * | 6/2005 | Ward | 62/625 |
| 2006/0016216 | A1 * | 1/2006 | Tonkovich et al. | 62/617 |
| 2007/0056319 | A1 * | 3/2007 | Billy et al. | 62/620 |
| 2012/0145529 | A1 * | 6/2012 | Nelson et al. | 203/23 |

OTHER PUBLICATIONS

"Process and Apparatus for Separation of Nitrogen From Carbon Monixide" Research Disclosure, Mason Publications, Hampshire, GB, No. 426, Oct. 1999, pp. 1335-1336.

Search Report for PCT/FR2007/052486.

Berninger, R., "Progress in H2/CO Low-Temperature Separation", Linde Reports on Science and Technology, vol. 62, 1988, pp. 18-23.

* cited by examiner

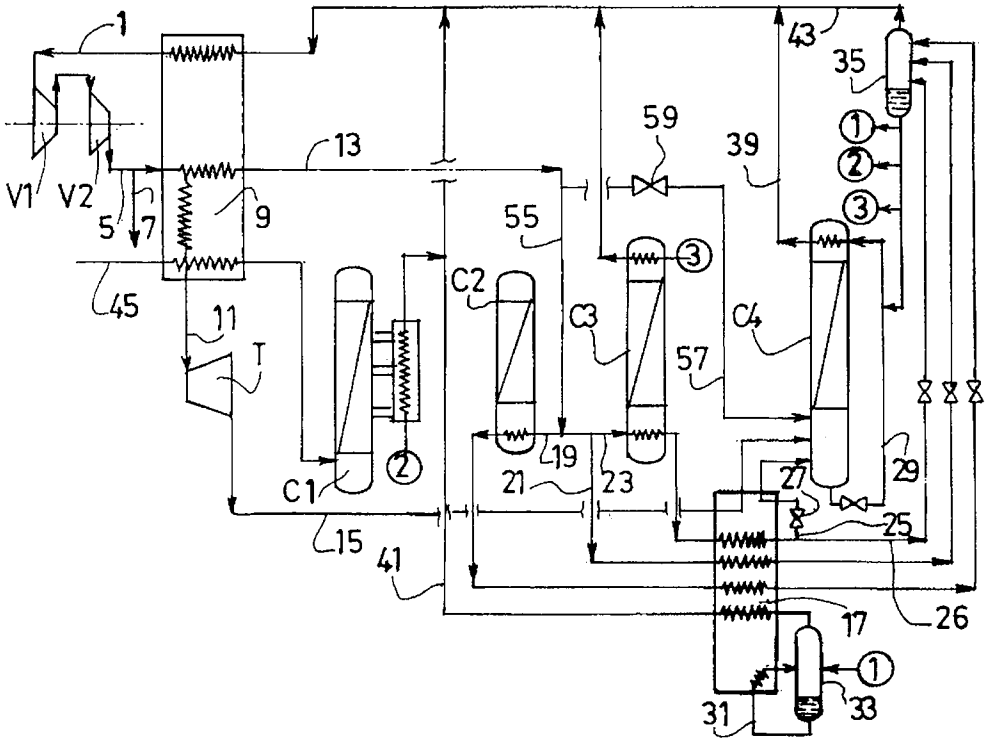
1
V1
V2
5
7
9
13
45
11
T
C1
15
41
C2
55
21
19
C3
23
59
39
43
35
C4
57
27
29
25
26
17
33
31

METHOD AND DEVICE FOR SEPARATING A MIXTURE OF AT LEAST HYDROGEN, NITROGEN, AND CARBON MONOXIDE BY CRYOGENIC DISTILLATION

This application is a §371 of International PCT Application PCT/FR2007/052486, filed Dec. 12, 2007.

FIELD OF THE INVENTION

The present invention relates to a method for separating a mixture of carbon monoxide, nitrogen, hydrogen and optionally methane by cryogenic distillation.

BACKGROUND

All the pressures mentioned are absolute pressures and the percentages are molar percentages.

It is known to separate such a mixture in order to produce carbon monoxide and hydrogen by a methane scrubbing process as described in Linde Reports on Science and Technology, "Progress in $H_2$/CO Low-Temperature Separation" by Berninger, 44/1988 and in "A New Generation of Cryogenic $H_2$/CO Separation Processes Successfully in Operation at Two Different Antwerp Sites" by Belloni, International Symposium on Gas Separation Technology, 1989.

Other documents that describe methane scrubbing processes comprise: EP-A-0928937, U.S. Pat. Nos. 4,478,621, 5,609,040 and Tieftemperaturtechnik, page 418.

The carbon monoxide derived from $H_2$/CO cold boxes entrains with it a large fraction of the nitrogen present in the feed gas. This phenomenon is linked to the difficulty in separating the two components CO and $N_2$, their bubble points being very close. Nevertheless, depending on the use which is made of the CO downstream of the cold box, it sometimes proves necessary to reduce its nitrogen content before exporting it.

In order to do this, recourse has conventionally been made to the installation in the cold box of a column known as a denitrogenation column, the function of which is to produce, at the bottom, carbon monoxide at the required purity. At the top of the column, a nitrogen purge containing a fraction of CO is recovered. The denitrogenation column is installed either upstream, or downstream of the CO/$CH_4$ separation column.

The reboiling of the denitrogenation column is carried out by an injection of carbon monoxide in vapor form in the bottom of the column.

This carbon monoxide comes from several sources, one of which is the vaporization of liquid carbon monoxide at medium pressure in the exchange line. This medium-pressure carbon monoxide is therefore high-pressure carbon monoxide which has been liquefied and will thus have two uses:

% providing refrigeration in the exchange line, which makes it possible to accordingly limit the low-pressure carbon monoxide requirements; and % covering at least one portion of the reboiling needs of the column, which makes it possible to reduce the supply of medium-pressure carbon monoxide from the compressor, that is to say a specifically compressed flow (certainly at a pressure below that of the cycle, since it is only compressed to the pressure of the denitrogenation column).

It therefore appears advantageous to maximize the portion of medium-pressure carbon monoxide vaporized.

This flow may be limited by two phenomena:

% the exchange line, which cannot obviously vaporize an unlimited amount of medium-pressure carbon monoxide; and % the maximum fraction of reboiling that is accepted originating from the vaporized medium-pressure carbon monoxide. Specifically, it is important to be able to vary the reboiling flow without destabilizing the exchange line and therefore without varying the flow of vaporized medium-pressure carbon monoxide. Similarly, it may prove that the exchange line, for example due to too large an installed surface area, cannot vaporize the required flow (this would make other fluids exit too cold, for example the gas feed of the CO/$CH_4$ column), and that it is therefore necessary to reduce the vaporized medium-pressure carbon monoxide, whilst the reboiling requirement is unchanged.

Depending on the case, the flow of vaporized medium-pressure carbon monoxide will therefore be sized by the exchange line or by the maximum admissible fraction in the reboiling of the CO/$N_2$ column. When it is possible to vaporize more medium-pressure carbon monoxide, but when there is limitation due to the reboiling and when this leads to compressing of the medium-pressure carbon monoxide in addition, there is an energy loss (which results in an a priori smaller exchange surface area).

The present invention aims to remove this constraint which leads to a sizeable energy loss on current estimates, and also to eliminate the medium-pressure gas outlet on the compressor which compresses the carbon monoxide to the high pressure (line, filter, valves, passages in the exchangers, controls, etc.).

SUMMARY OF THE INVENTION

According to one subject of the invention, a method is provided for separating a mixture of carbon monoxide, nitrogen, hydrogen and optionally methane by cryogenic distillation in a system of separation means comprising a turbine, a methane scrubbing column, a stripping column, a CO/$CH_4$ column and a denitrogenation column, the denitrogenation column being downstream or upstream of the CO/$CH_4$ column in which the mixture is separated in order to obtain a fluid enriched in carbon monoxide and containing nitrogen, this fluid is separated in the denitrogenation column, a flow of carbon monoxide originating from the column system is compressed in a compressor to a high pressure, optionally between 25 and 45 bars, high-pressure carbon monoxide is sent from the compressor to the turbine and from the turbine to the denitrogenation column, a fraction of the high-pressure carbon monoxide flow is used as product and another portion of the high-pressure carbon monoxide, optionally between 25 and 45 bars, is cooled before being expanded, characterized in that at least occasionally a variable amount of the other portion of high-pressure carbon monoxide cooled in a valve is expanded before being sent to the bottom of the denitrogenation column and the flow expanded in the valve is varied as a function of the reboiling needs of the denitrogenation column and a fraction of the high-pressure carbon monoxide, optionally between 25 and 45 bars, is sent to the bottom reboiler of the stripping column and/or of the CO/$CH_4$ column.

According to other optional aspects of the invention, it is provided that:

the high pressure is between 25 and 45 bars;

a flow of carbon-monoxide-rich gas sent to the bottom of the denitrogenation column is measured and the sending of high-pressure carbon monoxide expanded in the valve is triggered as a function of the flow of carbon-monoxide-rich gas sent to the bottom of the denitrogenation column;

the sending of high-pressure carbon monoxide expanded in the valve is triggered if the flow of carbon monoxide gas sent to the denitrogenation column is reduced by at least 5%, or even by at least 10% relative to the nominal flow;

the high pressure corresponds to the outlet pressure of the last stage of the compressor.

According to another subject of the invention, an installation is provided for separating a mixture of carbon monoxide, nitrogen, hydrogen and optionally methane by cryogenic distillation in a system of separation means comprising a turbine, a methane scrubbing column, a stripping column, a $CO/CH_4$ column and a denitrogenation column, the denitrogenation column being downstream or upstream of the $CO/CH_4$ column, means for sending the mixture to the system of separation means in order to obtain a fluid enriched in carbon monoxide and containing nitrogen, means for sending this fluid into the denitrogenation column, a compressor, means for sending a flow of carbon monoxide that originates from the column system to the compressor and means for collecting a flow of carbon monoxide at a high pressure at the outlet of the compressor, means for sending a portion of the high-pressure flow to the turbine and from the turbine to the denitrogenation column, means for sending another portion of the high-pressure flow to a bottom reboiler of the stripping column and/or of the $CO/CH_4$ column, means for recovering a fraction of the flow of high-pressure carbon monoxide as product, a heat exchanger where another portion of the high-pressure carbon monoxide is cooled and an expansion valve for the high-pressure carbon monoxide connected to the heat exchanger and to the denitrogenation column, means for varying the flow of high-pressure carbon monoxide expanded in the valve as a function of the reboiling requirements.

Optionally, the installation comprises means for measuring a flow of carbon-monoxide-rich gas sent as bottoms.

For a further understanding of the nature and objects for the present invention, reference should be made to the detailed description, taken in conjunction with the accompanying drawing, in which like elements are given the same or analogous reference numbers and wherein:

The idea is to size the device without the constraint on the fraction of reboiling independent of the medium-pressure carbon monoxide vaporized (and therefore it is accepted that all the reboiling can originate from the vaporization of the medium-pressure carbon monoxide). Next, a line is installed between the high-pressure carbon monoxide outlet to the reboilers of the stripping column and of the $CO/CH_4$ column (around −110° C.) and the feed for the reboiling of the $CO/N_2$ column. This line will therefore lead to the investment in the line itself and in a single valve (there are already valves on the upstream lines (going to the reboilers fed by the high-pressure carbon monoxide) and downstream lines (vaporized medium-pressure carbon monoxide)). The medium-pressure carbon monoxide thus produced does not pass into an exchange line and the flow can therefore be set to zero for operation of the device. During operation, if it is desired to reduce the medium-pressure carbon monoxide vaporized while retaining a higher reboiling flow, it is sufficient to top up via this medium-pressure carbon monoxide.

The advantage of injecting this "back-up" medium-pressure carbon monoxide into the high-pressure carbon monoxide intended for the reboilers of the columns is that the high-pressure carbon monoxide is often hotter than the "supplementary" high-pressure carbon monoxide that exits at the same temperature as the syngas from the first exchanger. The expansion of the high-pressure carbon monoxide to a pressure of around 4 bars (the operating pressure of the $CO/N_2$ column) does not produce liquid. Even if there were some, this would not hinder the operation, it would be sufficient to withdraw more therefrom in order to obtain the correct amount for reboiling.

This invention can be applied generally to any methane scrubbing devices with denitrogenation in the current system. However, when the flow of medium-pressure carbon monoxide that can be vaporized in the exchange line is very substantially smaller than the reboiling flow, it will nevertheless be advantageous to install a medium-pressure outlet on the compressor, to avoid expanding a large flow of the high pressure to the pressure of the column.

It can also be applied generally to any partial condensation devices.

BRIEF DESCRIPTION OF THE FIGURES

FIG. 1 illustrates a separation method according to an embodiment of the invention.

DETAILED DESCRIPTION OF THE INVENTION

The invention will be described in greater detail while referring to the FIGURE which shows a separation method according to the invention.

In order to simplify the figure, only the inlet of the gas to be treated and the carbon monoxide cycle are shown.

A flow containing carbon monoxide, hydrogen, methane and nitrogen 45 is cooled in the exchanger 9 by heat exchange with a flow of carbon monoxide 1 and is sent to a methane scrubbing column C1 fed at the top by a liquid methane flow at a very low temperature (not illustrated).

However, it will be understood (although it is not illustrated) that the liquid from the bottom of column C1 is sent to the top of the stripping column C2. The overhead gas from column C1 enriched with hydrogen exits the installation. The liquid from the bottom of the stripping column C2 is sent to a CO/methane separation column C3. The liquid from the bottom of column C3 is sent back to the top of column C1. The overhead gas from column C3 is sent to an intermediate point of the denitrogenation column C4 where it is separated into a carbon-monoxide-rich liquid at the bottom and a nitrogen-rich gas at the top. The operation of the columns therefore corresponds essentially to that of the process from FIG. 6 of Linde Reports on Science and Technology, "Progress in $H_2$/CO Low-Temperature Separation" by Berninger, 44/1988.

A flow of impure carbon monoxide 1 at a pressure of 2.6 bar is sent to the compressor V1, V2 in order to be compressed to a pressure between 25 and 45 bar, preferably between 35 and 40 bar in order to form the flow 5. This flow is divided into one portion 7 which constitutes a production and another flow which is sent to the exchanger 9. A fraction 13 passes completely through the exchanger before being divided in two. A first flow 55 is then divided into three flows 19, 21, 23. A first flow 19 is used to reboil the stripping column C2, a second flow 23 is used to reboil the CO/methane column C3, the two flows 19, 23 are thus liquefied and the cooled flows 19, 23 are sent with the third flow 21 to an exchanger 17. The flow 23 is divided in two, one portion 25 being expanded in a valve 27 then vaporized in the exchanger 17 and sent in gas form to the bottom of the denitrogenation column C4. The rest 26 of the flow 23 is expanded to a pressure of 2.6 bars and sent to a separator pot 35 after expansion in a valve. The flows 21, 19 are also expanded in valves and sent to the same separator pot 35.

It will be easily understood that one portion of one of the flows 19, 21 could be vaporized and sent to the bottom of the denitrogenation column C4 in addition to the flow 25 or instead of this flow 25.

The flow 57 of high-pressure carbon monoxide is expanded in a valve 59 and then sent to the bottom of the denitrogenation column C4. The sending of high-pressure carbon monoxide 57 expanded in the valve 59 is triggered if the flow of carbon monoxide gas 15, 25 sent to the denitrogenation column is reduced by at least 5%, or even by at least 10% relative to the nominal flow.

The gas 43 formed in the separator pot 35 is sent back to the compressor V1 after reheating in the exchanger 9.

The liquid from the separator pot 35 is divided into four. One portion 1 is sent to a separator pot 33 where it forms a gaseous fraction 41 and a liquid fraction 31. The liquid fraction 31 is vaporized in the exchanger 17. The gaseous fraction 41 is heated in the exchanger 17 against the flows 19, 21, 23 before being sent back to the compressor V1.

A portion 2 is used to subcool the methane scrubbing column C1 before being mixed with the flow 41.

A portion 3 is used to condense the top of the CO/methane column C3 where it is vaporized and is then sent back to compressor V1.

The fourth portion 37 is mixed with the bottoms liquid 29 from the denitrogenation column and is used to cool the top of this column. The flow formed 39 is sent back to compressor V1.

Finally, a flow 11 is partially cooled in the exchanger 9, is expanded in a turbine T, is cooled in the exchanger 17 as flow 15 and is sent to the bottom of the denitrogenation column C4.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for separating a mixture of carbon monoxide, nitrogen, hydrogen and optionally methane by cryogenic distillation in a system of separation means wherein the system includes a turbine, a valve, a methane scrubbing column, a stripping column, a $CO/CH_4$ column, and a denitrogenation column having a top, bottom, and a reboiler, the reboiler having reboiling needs, wherein the denitrogenation column is disposed upstream or downstream the $CO/CH_4$ column, wherein the valve is disposed upstream the denitrogenation column, the method comprising the steps of;

a) removing hydrogen and optionally methane from said mixture of carbon monoxide, nitrogen, hydrogen and optionally methane, thereby producing a fluid enriched in carbon monoxide and containing nitrogen;

b) removing nitrogen from said fluid enriched in carbon monoxide and containing nitrogen in said denitrogenation column, thereby producing a carbon monoxide rich fluid;

c) compressing at least a portion of said carbon monoxide rich fluid in a compressor, thereby producing a high-pressure carbon monoxide stream;

d) collecting at least a first fraction of said high-pressure carbon monoxide stream as product;

e) cooling a second fraction of said high-pressure carbon monoxide stream;

f) introducing a third fraction of said high-pressure carbon monoxide stream to said turbine and from said turbine to the bottom of said denitrogenation column for further separation;

g) expanding a first portion of said second fraction of the high-pressure carbon monoxide stream using the valve before sending to the bottom of said denitrogenation column for further separation; and h) introducing a second portion of the second fraction of the high-pressure carbon monoxide stream to a bottom eboiler of said stripping column and/or of said $CO/CH_4$ column, i) varying the flow of the first portion of said second fraction of the high-pressure carbon monoxide stream across the valve as a function of the reboiling needs of the reboiler of said denitrogenation column.

2. The method as claimed in claim 1, wherein the high-pressure carbon monoxide stream is at a pressure between 25 and 45 bars.

3. The method as claimed in claim 1, wherein the high-pressure carbon monoxide stream is at a pressure between 35 and 45 bars.

4. The method as claimed, in claim 1, wherein the high-pressure carbon monoxide stream has a pressure that corresponds to the outlet pressure of a last stage of the compressor.

5. The method as claimed in claim 1 further comprising the steps of:

measuring a total flow rate carbon monoxide rich gas sent to the bottom of the denitrogenation column; and adjusting the flow rate of the first portion of the second fraction of the high-pressure carbon monoxide strew expanded in the valve as a function of the measured total flow rate of the carbon monoxide rich gas sent to the bottom of the denitrogenation column.

6. The method as claimed in claim 5, wherein the step of adjusting the flow rate of the first portion of the second fraction of the high-pressure carbon monoxide stream expanded in the valve is triggered if the total flow rate of carbon monoxide rich gas sent to the bottom of the denitrogenation column is reduced by at least 5% relative to a nominal flow.

7. The method as claimed in claim 1, wherein the reboiling needs of the reboiler of the denitrogenation column are a function of a total flow rate of carbon monoxide rich gas sent to the bottom of the denitrogenation column.

8. The method as claimed in claim 1 further comprising the steps of reducing the pressure of a portion of the stream resulting from step h) and then introducing said portion to the bottom of the denitrogenation column.

9. An installation for separating a mixture of carbon monoxide, nitrogen, hydrogen and optionally methane by cryogenic distillation in a system of separation means comprising a turbine, a methane scrubbing column, a stripping column, a $CO/CH_4$column, and a denitrogenation column, the denitrogenation column being downstream or upstream of the $CO/CH_4$ column, the denitrogenation column having a top, a bottom, and a reboiler, the reboiler having reboiling needs, wherein the installation further comprises:

means for sending the mixture to the system of separation means in order to obtain a fluid enriched in carbon monoxide and containing nitrogen;

means for sending said fluid enriched in carbon monoxide and containing nitrogen into the denitrogenation column;

a compressor;

means for sending a flow of carbon monoxide that originates from the system of separation means to the compressor, the compressor being operable to create a high-pressure carbon monoxide stream;

means for collecting a first fraction of the high-pressure carbon monoxide stream as a product;

means for sending a third fraction of the high-pressure carbon monoxide stream to the turbine and from the turbine to the denitrogenation column for further separation;

means for sending a second portion of a second fraction of the high-pressure carbon monoxide stream to a bottom reboiler of the stripping column and/or of the $CO/CH_4$ column;

a heat exchanger configured to provide heat exchange for the installation;

means for sending a first portion of the second fraction of the high-pressure carbon monoxide stream to an expansion valve and then to the bottom of the denitrogenation column for further separation, the expansion valve configured to lower the pressure of the first portion of the second fraction of the high-pressure carbon monoxide stream to have the same pressure as the denitrogenation column;

means for varying the flow of the first portion of the second fraction of the high-pressure carbon monoxide stream expanded in the valve as a function of the reboiling needs of the reboiler of the denitrogenation column.

10. The installation as claimed in claim 9, further comprising means for measuring a flow of carbon-monoxide-rich gas sent to the bottom of the denitrogenation column and means for adjusting the flow of the first portion of the second fraction of the high-pressure carbon monoxide stream that is expanded in the valve as a function of the flow of carbon-monoxide-rich gas sent to the bottom of the denitrogenation column.

11. The method as claimed in claim 1, wherein first portion of said second fraction of the high-pressure carbon monoxide stream expanded using the valve is not introduced to the bottom reboiler of said stripping column or said CO/CH4 column.

* * * * *

UNITED STATES PATENT AND TRADEMARK OFFICE

CERTIFICATE OF CORRECTION

PATENT NO. : 8,555,673 B2
APPLICATION NO. : 12/519990
DATED : October 15, 2013
INVENTOR(S) : Arthur Darde et al.

It is certified that error appears in the above-identified patent and that said Letters Patent is hereby corrected as shown below:

On the Title Page, Item (73)

Change "L'Air Liquide, Société pour l'Étude et l'Éxploitation des Procédés Georges Claude" to --L'Air Liquide, Société Anonyme pour l'Étude et l'Éxploitation des Procédés Georges Claude--

Signed and Sealed this
Twenty-sixth Day of November, 2013

Margaret A. Focarino

Margaret A. Focarino
*Commissioner for Patents of the United States Patent and Trademark Office*